US006169970B1

(12) United States Patent
Kleijn

(10) Patent No.: US 6,169,970 B1
(45) **Date of Patent: *Jan. 2, 2001**

(54) GENERALIZED ANALYSIS-BY-SYNTHESIS SPEECH CODING METHOD AND APPARATUS

(75) Inventor: Willem Bastiaan Kleijn, Basking Ridge, NJ (US)

(73) Assignee: Lucent Technologies Inc., Murray Hill, NJ (US)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/004,407

(22) Filed: Jan. 8, 1998

(51) Int. Cl.[7] ..... G10L 19/04
(52) U.S. Cl. ..... 704/219
(58) Field of Search ..... 704/200, 220–233

(56) References Cited

U.S. PATENT DOCUMENTS

| | | | |
|---|---|---|---|
| 4,885,790 | 12/1989 | McAulay et al. | 381/36 |
| 4,899,385 | 2/1990 | Ketchum et al. | 381/36 |
| 4,910,781 | 3/1990 | Ketchum et al. | 381/36 |
| 5,224,167 | 6/1993 | Taniguchi et al. | 381/36 |
| 5,267,317 | 11/1993 | Kleijn | 381/38 |
| 5,268,991 | 12/1993 | Tasaki | 395/2.29 |

OTHER PUBLICATIONS

B.S. Atal et al., "Stochastic Coding of Speech at Very Low Bit Rates," Proc. Int. Conf. Comm., Amsterdam, pp. 1610–1613, 1984.

P. Kroon et al., "Pitch Predictors with High Temporal Resolution," pp. 661–664, 1990.

M. Honda, "Speech Coding Using Waveform Based on LPC Residual Phase Equalization," pp. 213–216, 1990.

Y. Shoham, "Constrained–Stochastic Excitation Coding of speech at 4.8 KB/S," Advances in Speech Coding, pp. 339–348, 1991.

T. Taniquichi et al., "Pitch Sharpening For Perceputally," Proc. Int. Conf. Acoust. Speech and Sign. Process., 1991, pp. 241–244.

C. G. Bell et al., "Reduction of Speech Spectra by Analysis–by–Synthesis Techniques," J. Acoust. Soc. Am., pp. 1725–1736, 1961.

S. Singhal et al., "Improving Performance of Multi–Pulse LPC Coders at Low Bit Rates," Proc. Int. Conf. Acoust. speech and Sign. Process., pp. 1.3.1–1.3.4, 1984.

W.B. Kleijn et al., "An Efficient Stochastically Excited Linear Predictive coding Algorithm for High Quality Low Bit Rate Transmission of Speech," Speech Communication VII, pp. 305–316, 1988.

(List continued on next page.)

*Primary Examiner*—Krista Zele
*Assistant Examiner*—Michael N. Opsasnick
(74) *Attorney, Agent, or Firm*—Kenneth M. Brown; Thomas A. Restaino

(57) ABSTRACT

A generalized analysis-by-synthesis method and apparatus are disclosed. A plurality of trial original signals are generated based on an original signal for coding. The trial original signals are constrained to be perceptually similar to the original signal. Trial original signals are coded to produce one or more parameters representative thereof. Estimates of the trial original signals are synthesized from these parameters. Errors between the trial original signals and the synthesized estimates are determined. A coded representation of the original signal is determined which comprises parameters of the trial original signal having an associated error which satisfies an error evaluation process. Trial original signals may be generated by application of time-warps or time-shifts to the original signal. Coding of a trial original signal may be performed with conventional analysis-by-synthesis coding such as code-excited linear prediction coding (CELP). A minimum square error process may serve as the error criterion.

20 Claims, 3 Drawing Sheets

OTHER PUBLICATIONS

P. Kroon et al., "Predictive coding of speech Using Analysis–by–Synthesis Techniques," Advances in Speech signal Processing, pp. 141–164, 1991.

W.B. Kleijn et al., "Fast Methods for the CELP Speech Coding Algorithm," IEEE Trans. Acoust. Speech Sign. Proc., 38(8), pp. 1330–1342, 1990.

P. Kroon, "A Class of Analysis–by–Synthesis Predictive Coders For High Quality Speech Coding at Rates Between 4.8 and 16 kbits/s," IEEE Journal on Comm, No. 2, vol. 6, Feb. 1988, pp. 353–363.

P. Kroon et al., "Regular–Pulse Excitation—A Novel Approach to Effective and Efficient Multipulse Coding of speech," IEEE Trans. on ASSP, vol. ASSP–34, No. 5, Oct. 1986, pp. 1054–1063.

H. W. Strube, "Linear Prediction on a Warped Frequency Scale," Journal of the Acoustical society of America, Oct. 1980, pp. 1071–1076.

Reduced–complexity stochastically–excited coder for the low bit–rate coding of speech, by K. K. Paliwak, International Journal of Electronics, vol. 67, No. 2, Aug. 1989, pp. 173–178.

On Reducing computational complexity of codebook Search in CELP Coding, by J.I. Lee et al., IEEE Transactions on Communications, vol. 38, No. 11, Nov. 1990, pp. 1935–1937.

LPC Speech coding Based on Variable–Length Segment Quantization, by Y. Shiraki et al., IEEE Transanctions on Acoustics, Speech, and Signal Processing, vol. 36, No. 9, Sep. 1988, pp. 1437–1444.

Generalized Analysis–by Synthesis Coding and Its Application to Pitch Prediction, by W. B. Kleijn et al., International Conference on Acoustic, Speech and Signal Processing, vol. 1, Mar. 23, 1992, pp. 337–340.

GENERALIZED ANALYSIS-BY-SYNTHESIS SPEECH CODING METHOD AND APPARATUS

FIELD OF THE INVENTION

The present invention relates generally to speech coding systems and more specifically to a reduction of bandwidth requirements in analysis-by-synthesis speech coding systems.

BACKGROUND OF THE INVENTION

Speech coding systems function to provide codeword representations of speech signals for communication over a channel or network to one or more system receivers. Each system receiver reconstructs speech signals from received codewords. The amount of codeword information communicated by a system in a given time period defines system bandwidth and affects the quality of speech reproduced by system receivers.

Designers of speech coding systems often seek to provide high quality speech reproduction capability using as little bandwidth as possible. However, requirements for high quality speech and low bandwidth may conflict and therefore present engineering trade-offs in a design process. This notwithstanding, speech coding techniques have been developed which provide acceptable speech quality at reduced channel bandwidths. Among these are analysis-by-synthesis speech coding techniques.

With analysis-by-synthesis speech coding techniques, speech signals are coded through a waveform matching procedure. A candidate speech signal is synthesized from one or more parameters for comparison to an original speech signal to be encoded. By varying parameters, different synthesized candidate speech signals may be determined. The parameters of the closest matching candidate speech signal may then be used to represent the original speech signal.

Many analysis-by-synthesis coders, e.g., most code-excited linear prediction (CELP) coders, employ a long-term predictor (LTP) to model long-term correlations in speech signals. (The term "speech signals" means actual speech or any of the excitation signals present in analysis-by-synthesis coders.) As a general matter, such correlations allow a past speech signal to serve as an approximation of a current speech signal. LTPs work to compare several past speech signals (which have already been coded) to a current (original) speech signal. By such comparisons, the LTP determines which past signal most closely matches the original signal. A past speech signal is identifiable by a delay which indicates how far in the past (from current time) the signal is found. A coder employing an LTP subtracts a scaled version of the closest matching past speech signal (i.e., the best approximation) from the current speech signal to yield a signal (sometimes referred to as a residual or excitation with reduced long-term correlation. This signal is then coded, typically with a fixed stochastic codebook (FSCB). The FSCB index and LTP delay, among other things, are transmitted to a CELP decoder which can recover an estimate of the original speech from these parameters.

By modeling long-term correlations of speech, the quality of reconstructed speech at a decoder may be enhanced. This enhancement, however, is not achieved without a significant increase in bandwidth. For example, in order to model long-term correlations in speech, conventional CELP coders may transmit 8-bit delay information every 5 or 7.5 ms (referred to as a subframe). Such time-varying delay parameters require, e.g., between one and two additional kilobits (kb) per second of bandwidth. Because variations in LTP delay may not be predictable over time (i.e., a sequence of LTP delay values may be stochastic in nature), it may prove difficult to reduce the additional bandwidth requirement through the coding of delay parameters.

One approach to reducing the extra bandwidth requirements of analysis-by-synthesis coders employing an LTP might be to transmit LTP delay values less often and determine intermediate LTP delay values by interpolation. However, interpolation may lead to suboptimal delay values being used by the LTP in individual subframes of the speech signal. For example, if the delay is suboptimal, then the LTP will map past speech signals into the present in a suboptimal fashion. As a result, any remaining excitation signal will be larger than it might otherwise be. The FSCB must then work to undo the effects of this suboptimal time-shift rather than perform its normal function of refining waveform shape. Without such refinement, significant audible distortion may result.

SUMMARY OF THE INVENTION

The present invention provides a method and apparatus for reducing bandwidth requirements in analysis-by-synthesis speech coding systems. The present invention provides multiple trial original signals based upon an actual original signal to be encoded. These trial original signals are constrained to be audibly similar to the actual original signal and are used in place of or supplement the use of the actual original in coding. The original signal, and hence the trial original signals, may take the form of actual speech signals or any of the excitation signals present in analysis-by-synthesis coders. The present invention affords generalized analysis-by-synthesis coding by allowing for the variation of original speech signals to reduce coding error and bit rate. The invention is applicable to, among other things, networks for communicating speech information, such as, for example, cellular and conventional telephone networks.

In an illustrative embodiment of the present invention, trial original signals are used in a coding and synthesis process to yield reconstructed original signals. Error signals are formed between the trial original signals and the reconstructed signals. The trial original signal which is determined to yield the minimum error is used as the basis for coding and communication to a receiver. By reducing error in this fashion, a coding process may be modified such that required system bandwidth may be reduced.

In a further illustrative embodiment of the present invention for a CELP coder, one or more trial original signals are provided by application of a codebook of time-warps to the actual original signal. In an LTP procedure of the CELP coder, trial original signals are compared with a candidate past speech signal provided by an adaptive codebook. The trial original signal which most closely compares to the candidate is identified. As part of the LTP process, the candidate is subtracted from the identified trial original signal to form a residual. The residual is then coded by application of a fixed stochastic codebook. As a result of using multiple trial original signals in the LTP procedure, the illustrative embodiment of the present invention provides improved mapping of past signals to the present and, as a result, reduced residual error. This reduced residual error affords less frequent transmission of LTP delay information and allows for delay interpolation with little or no degradation in the quality of reconstructed speech.

Another illustrative embodiment of the present invention provides multiple trial original signals through a time-shift technique.

DETAILED DESCRIPTION

Introduction

Figure 1:
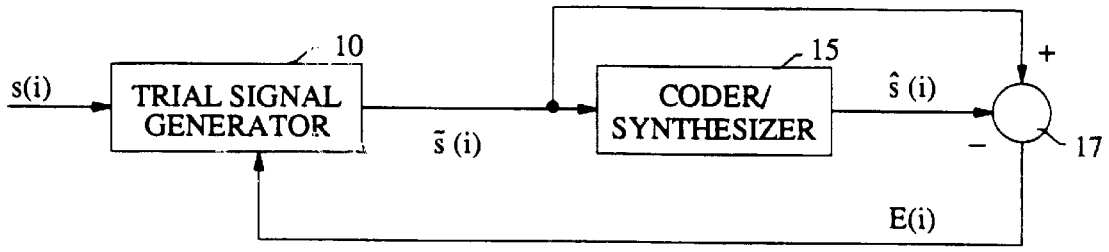
FIG. 1 presents an illustrative embodiment of the present invention.

FIG. 1 presents an illustrative embodiment of the present invention. An original speech signal to be encoded, S(i), is provided to a trial original signal generator 10. The trial original signal generator 10 produces a trial original signal $\tilde{S}(i)$ which is audibly similar to the original signal S(i). Trial original signal $\tilde{S}(i)$ is provided to a speech coder/synthesizer 15 which (i) determines a coded representation for $\tilde{S}(i)$ and (ii) further produces a reconstructed speech signal, $\hat{S}(i)$, based upon the coded representation of $\tilde{S}(i)$. A difference or error signal, E(i), is formed between trial original speech signal $\tilde{S}(i)$ and $\hat{S}(i)$ by subtraction circuit 17. Signal E(i) is fed back to the trial original signal generator 10 which selects another trial original signal in an attempt to reduce the magnitude of the error signal, E(i). The embodiment thereby functions to determine, within certain constraints, which trial original signal, $\tilde{S}_{min}(i)$, yields a minimum error, $E_{min}(i)$. Once $\tilde{S}_{min}(i)$ is determined, parameters used by the coder/synthesizer 15 to synthesize the corresponding $\hat{S}(i)$ may serve as the coded representation of $\tilde{S}_{min}(i)$ and hence, S(i).

The present invention provides generalization for conventional analysis-by-synthesis coding by recognizing that the original signals may be varied to reduce error in the coding process. As such, the coder/synthesizer 15 may be any conventional analysis-by-synthesizer coder, such as conventional CELP.

Conventional CELP

Figure 2:
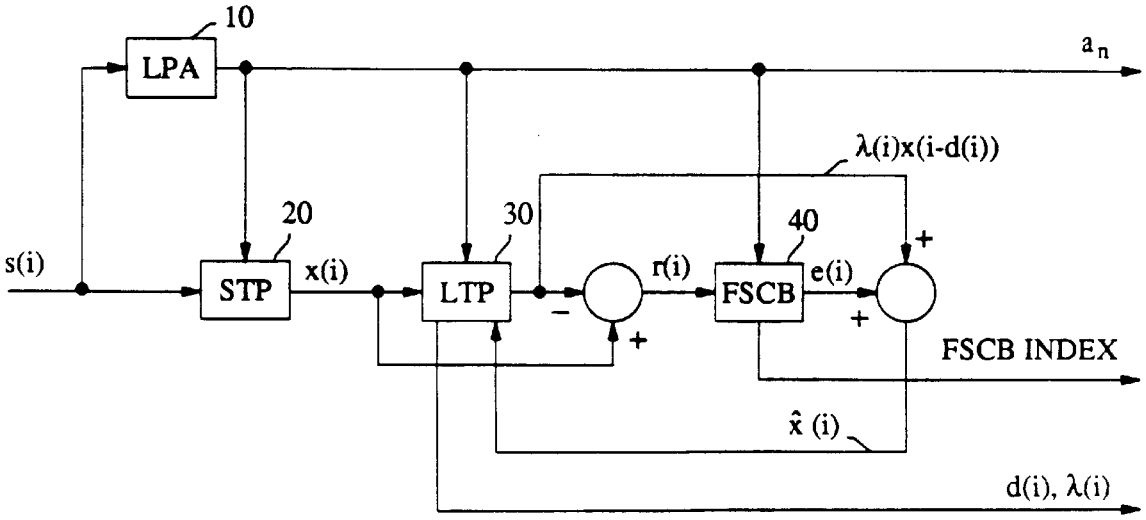
FIG. 2 (PRIOR ART)
FIG. 2 presents a conventional CELP coder.

A conventional analysis-by-synthesis CELP coder is presented in FIG. 2. A sampled speech signal, s(i), (where i is the sample index) is provided to a short-term linear prediction filter (STP) 20 of order N, optimized for a current segment of speech. Signal x(i) is an excitation obtained after filtering with the STP:

$$x(i) = s(i) - \sum_{n=1}^{N} a_n s(i-n), \tag{1}$$

where parameters $a_n$ are provided by linear prediction analyzer 10. Since N is usually about 10 samples (for an 8 kHz sampling rate), the excitation signal x(i) retains the long-term periodicity of the original signal, s(i). An LTP 30 is provided to remove this redundancy.

Values for x(i) are usually determined on a blockwise basis. Each block is referred to as a subframe. The linear prediction coefficients, $a_n$, are determined by the analyzer 10 on a frame-by-frame basis, with a frame having a fixed duration which is generally an integral multiple of subframe durations, and usually 20–30 ms in length. Subframe values for $a_n$ are usually determined through interpolation.

The LTP determines a gain λ(i) and a delay d(i) for use as follows:

$$r(i)=x(i)-\lambda(i)\hat{x}(i-d(i)), \tag{2}$$

where the $\hat{x}(i-d(i))$ are samples of a speech signal synthesized (or reconstructed) in earlier subframes. Thus, the LTP 30 provides the quantity λ(i) $\hat{x}(i-d(i))$. Signal r(i) is the excitation signal remaining after λ(i) $\hat{x}(i-d(i))$ is subtracted from x(i). Signal r(i) is then coded with a FSCB 40. The FSCB 40 yields an index indicating the codebook vector and an associated scaling factor, μ(i). Together these quantities provide a scaled excitation which most closely matches r(i).

Data representative of each subframe of speech, namely, LTP parameters λ(i) and d(i), and the FSCB index, are collected for the integer number of subframes equalling a frame (typically 2, 4 or 6). Together with the coefficients $a_n$, this frame of data is communicated to a CELP decoder where it is used in the reconstruction of speech.

A CELP decoder performs the reverse of the coding process discussed above. The FSCB index is received by a FSCB of the receiver (sometimes referred to as a synthesizer) and the associated vector e(i) (an excitation signal) is retrieved from the codebook. Excitation e(i) is used to excite an inverse LTP process (wherein long-term correlations are provided) to yield a quantized equivalent of x(i), $\hat{x}(i)$. A reconstructed speech signal, y(i), is obtained by filtering $\hat{x}(i)$ with an inverse STP process (wherein short-term correlations are provided).

In general, the reconstructed excitation $\hat{x}(i)$ can be interpreted as the sum of scaled contributions from the adaptive and fixed codebooks. To select the vectors from these codebooks, a perceptually relevant error criterion may be used. This can be done by taking advantage of the spectral masking existing in the human auditory system. Thus, instead of using the difference between the original and reconstructed speech signals, this error criterion considers the difference of perceptually weighted signals.

The perceptual weighting of signals deemphasizes the formants present in speech. In this example, the formants are described by an all-pole filter in which spectral deemphasis can be obtained by moving the poles inward. This is equivalent to replacing the filter with predictor coefficients $a_1, a_2, \ldots, a_N$, by a filter with coefficients $\gamma a_1, \gamma^2 a_2, \ldots, \gamma^N a_N$, where γ is a perceptual weighting factor (usually set to a value around 0.8).

The samples error signal in the perceptually weighted domain, g(i), is:

$$g(i) = x(i) - \hat{x}(i) + \sum_{n=1}^{N} \gamma^n a_n g(i-n) \tag{3}$$

The error criterion of analysis-by-synthesis coders is formulated on a subframe-by-subframe basis. For a subframe length of L samples, a commonly used criterion is:

$$\varepsilon = \sum_{i=\hat{i}}^{\hat{i}+L-1} g(i)^2 \tag{4}$$

where $\hat{i}$ is the first sample of the subframe. Note that this criterion weighs the excitation samples unevenly over the subframe; the sample $\hat{x}(\hat{i}+L-1)$ affects only $g(\hat{i}+L-1)$, while $\hat{x}(\hat{i})$ affects all samples of g(i) in the present subframe.

The criterion of equation (4) includes the effects of differences in x(i) and $\hat{x}(i)$ prior to $\hat{i}$, i.e., prior to the beginning of the present subframe. It is convenient to define an excitation in the present subframe to represent this zero-input response of the weighted synthesis filter.

$$q(i) = \begin{cases} 0, & i < \hat{i}, \\ z(i) - \sum_{n=1}^{i-\hat{i}} \gamma^n a_n q(i-n), & \hat{i} \le i < \hat{i} + N \\ 0, & i \ge \hat{i} + N \end{cases} \tag{5}$$

where z(i) is the zero-input response of the perceptually-weighted synthesis filter when excited with $x(i)-\hat{x}(i)$.

In the time-domain, the spectral deemphasis by the factor $\gamma$ results in a quicker attenuation of the impulse response of the all-pole filter. In practice, for a sampling rate of 8 kHz, and $\gamma=0.8$, the impulse response never has a significant part of its energy beyond 20 samples.

Because of its fast decay, the impulse response of the all-pole filter $1/(1-\gamma a_1 z^{-1} \ldots -\gamma^N a_N z^{-N})$ can be approximated by a finite-impulse-response filter. Let $h_0, h_1, \ldots, h_{R-1}$ denote the impulse response of the latter filter. This allows vector notation for the error criterion operating on the perceptually-weighted speech. Because the coders operate on a subframe-by-subframe basis, it is convenient to define vectors with the length of the subframe in samples, L. For example, for the excitation signal:

$$\hat{x}(i) = [\hat{x}(i)\hat{x}(i+1) \ \ldots \ \hat{x}(i+L-1)]^T. \tag{6}$$

Further, the spectral-weighting matrix H is defined as:

$$H = \begin{bmatrix} h_0 & 0 & \cdots & 0 \\ h_1 & h_0 & & \\ \vdots & & & \vdots \\ h_{R-1} & h_{R-2} & & \\ 0 & h_{R-1} & & \\ & & \ddots & h_0 \\ & & & h_1 \\ \vdots & & & \vdots \\ & & h_{R-1} & h_{R-2} \\ 0 & \cdots & 0 & h_{R-1} \end{bmatrix} \tag{7}$$

H has dimensions (L+R−1)×L. Thus, the vector $H\hat{x}(i)$ approximates the entire response of the IIR filter $1/(1-\gamma a_1 z^{-1} \ldots -\gamma^N a_N z^{-N})$ to the vector $\hat{x}(i)$. With these definitions an appropriate perceptually-weighted criterion is:

$$\epsilon = [x(i)+q(i)-\hat{x}(i)]^{T\,H^T} H[x(i)+q(i)-\hat{x}(i)]. \tag{8}$$

With the current definition of H the error criterion of equation (8) is of the autocorrelation type (note that $H^T H$ is Toeplitz). If the matrix H is truncated to be square L×L, equation (8) approximates equation (4), which is the more common covariance criterion, as used in the original CELP.

An Illustrative Embodiment for CELP Coding

Figure 3:
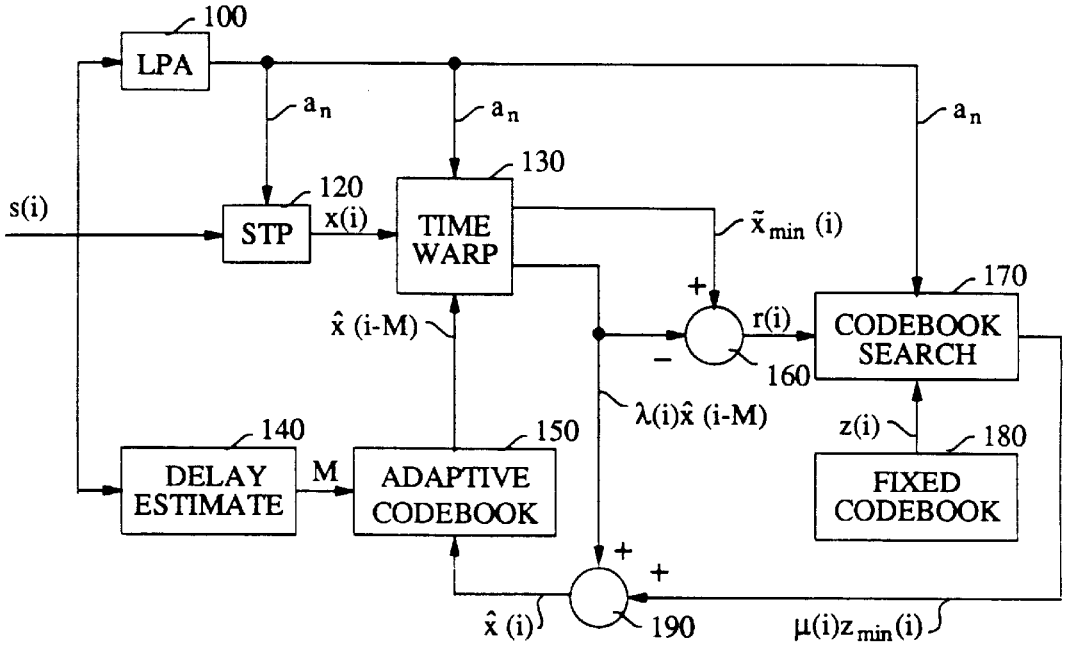
FIG. 3 presents an illustrative embodiment of the present invention.

FIG. 3 presents an illustrative embodiment of the present invention as it may be applied to CELP coding. A samples speech signal, s(i), is presented for coding. Signal s(i) is provided to a linear predictive analyzer 100 which produces linear predictive coefficients, $a_n$. Signal s(i) is also provided to an STP 120, which operates according to a process described by Eq. (1), and to a delay estimator 140.

Delay estimator 140 operates to search the recent past history of s(i) (e.g., between 20 and 160 samples in the past) to determine a set of consecutive past samples (of length equal to a subframe) which most closely matches the current subframe of speech, s(i), to be coded. Delay estimator 140 may make its determination through a correlation procedure of the current subframe with the contiguous set of past sample s(i) values in the interval $i-160 \leqq i \leqq i-20$. An illustrative correlation technique is that used by conventional open-loop LTPs of CELP coders. (The term open-loop refers to an LTP delay estimation process using original rather than reconstructed past speech signals. A delay estimation process which uses reconstructed speech signals is referred to as closed-loop. The delay estimator 140 determines a delay estimate by the above described procedure once per frame. Delay estimator 140 computes delay values M for each subframe by interpolation of delay values determined at frame boundaries.

Adaptive codebook 150 maintains an integer number (typically 128 or 256) of vectors of reconstructed past speech signal information. Each such vector, $\hat{x}(i)$, is L samples in length (the length of a subframe) and partially overlaps neighbor codebook vectors, such that consecutive vectors are distinct by one sample. As shown in FIG. 3, each vector is formed of the sum of past adaptive codebook 150 and fixed codebook 180 contributions to the basic waveform matching procedure of the CELP coder. The delay estimate, M, is used as an index to stored adaptive codebook vectors.

Responsive to receiving M, adaptive codebook 150 provides a vector, $\hat{x}(i-M)$, comprising L samples beginning M+L samples in the past and ending M samples in the past. This vector of past speech information serves as an LTP estimate of the present speech information to be coded.

As described above, the LTP process functions to identify a past speech signal which best matches a present speech signal so as to reduce the long term correlation in coded speech. In the illustrative embodiment of FIG. 3, multiple trial original speech signals are provided for the LTP process. Such multiple trial original signals are provided by time-warp function 130.

Figure 4:
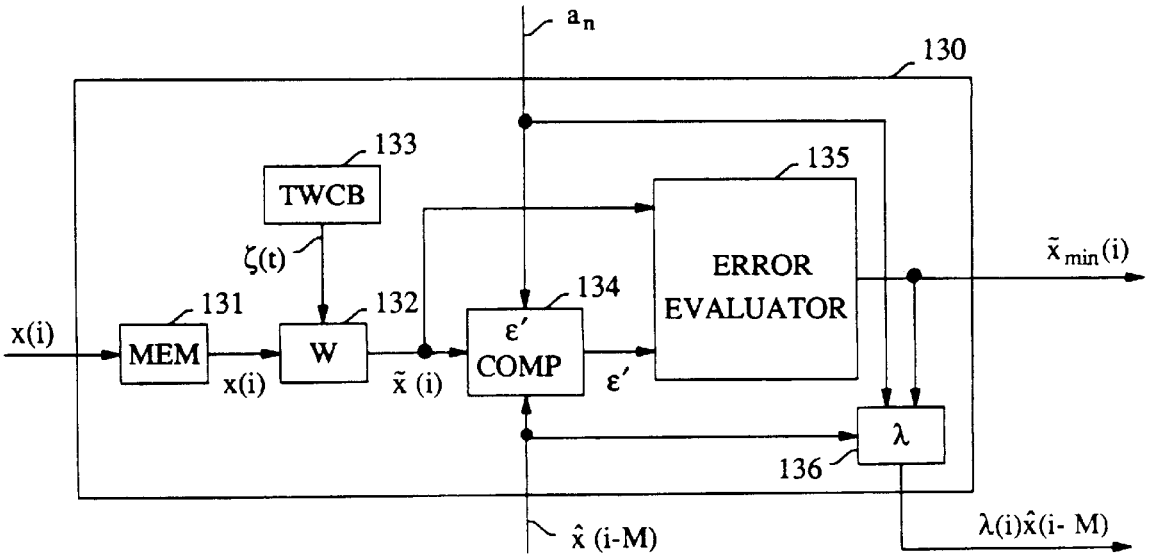
FIG. 4 presents an illustrative time-warp function for the embodiment presented in FIG. 3.

Time-warp function 130, presented in FIG. 4, provides a codebook 133 of time-warps (TWCB) for application to original speech to produce multiple trial original signals. In principle, the codebook 133 of time-warp function 130 may include any time-warp, $$\tilde{x}(\tau) = \tilde{x}\left(\tau_j + \int_{t_j}^{t} \zeta(t)dt\right) = x(t), \quad t_j < t \le t_{j+1}, \tag{9}$$

(where $\tau$ is a warped time-scale), which does not change the perceptual quality of the original signal:

$$\zeta(t_{j+1}) = \frac{\tau_{j+1} - \tau_j}{t_{j+1} - t_j} = \frac{\int_{t_j}^{t_{j+1}} \zeta(t)dt}{t_{j+1} - t_j}. \tag{10}$$

where $t_j$ and $\tau_j$ denote the start of the current subframe j in the original and warped domains, where x(t) is a continuous time bandlimited signal generated through conventional bandlimited interpolation of x(i), and where $\tilde{x}(\tau)$ is a continuous time signal in the warped domain.

To help insure stability of the warping process, it is preferred that major pitch pulses fall near the right hand boundary of the subframes. This can be done by defining sub-frame boundaries to fall just to the right of such pulses using known techniques. Assuming that the pitch pulses of the speech signal to be coded are at the boundary points, it is preferred that warping functions satisfy:

$$\zeta(t) = A + B\exp\left(-\frac{(t-t_j)}{\sigma_B}\right) + C(t-t_j)\exp\left(-\frac{(t-t_j)}{\sigma_C}\right), \quad t_j < t \le t_{j+1}, \tag{11}$$

If the pitch pulses are somewhat before the subframe boundaries, $\zeta(t)$ should maintain its end value in this neighborhood of the subframe boundary. If equation (10) is not satisfied, oscillating warps may be obtained. The following family of time-warping functions may be used to provide a codebook of time-warps:

$$\zeta(t) \Delta \frac{d\tau}{dt}$$

where A, B, C, $\sigma_B$, and $\sigma_C$ are constants. The warping function converges towards A with increasing t. At $t_j$ the value of the warping function is just A+B. The value of C can be used to satisfy equation (10) exactly. A codebook of continuous time-warps can be generated by 1) choosing a value for A, (typically between 0.95 and 1.05), 2) choosing values for $\sigma_B$ and $\sigma_C$ (typically on the order of 2.5 ms), 3) use B to satisfy the boundary condition at $t_j$ (where $\zeta(t_j)$= A+B), and 4) choose C to satisfy the boundary condition of equation (10). Note that no information concerning the warping codebook is transmitted; its size is limited only by the computational requirements.

Referring to FIG. 4, original speech signal x(i) is received by the time-warping process 130 and stored in memory 131. Original speech signal x(i) is made available to the warping process 132 as needed. Warping process receives a vector of parameters (A, B, C, $\sigma_B$, $\sigma_C$) describing a warping function $\zeta(t)$ from a time-warp codebook 133 and applies the function defined by such parameters to the original signal according to equation (9). Equation (9) relates continuous bandlimited signals x(t) and $\tilde{x}(\tau)$. Sample values of $\tilde{x}(i)$ may be determined from x(i) based on the relation. Discrete values of i are equal to integral multiple values of $\tau$. Warping process 132 determines a value of $\tilde{x}(i)$ (at a given integral multiple value of $\tau$) by first determining an upper limit, t, in the integral of the function $\zeta(t)$ according to equation (9) which upper limit results in the desired integral value of $\tau$. This value of t is then used by warping process 132 to identify a value, x(t), which is equal to $\tilde{x}(\tau)$ (and therefore $\tilde{x}(i)$) according to equation (9). Warping process 132 forms bandlimited signal x(t) by bandlimited interpolation of x(i), as is conventional. A time-warped original speech signal, $\tilde{x}(i)$, referred to as a trial original, is supplied to process 134 which determines a squared difference or error quantity, $\epsilon'$. Process 134 comprises software which implements equation (12).

$$\varepsilon' = \frac{[(\tilde{x}(i)+q(i))^T H^T H\hat{x}(i-M)]^2}{(\tilde{x}(i)+q(i))^T H^T H(\tilde{x}(i)+q(i))\hat{x}(i-M)^T H^T H\hat{x}(i-M)}. \tag{12}$$

Equation (12) is similar to equation (8) except that, unlike equation (8), equation (12) has been normalized thus making a least squares error process sensitive to differences of shape only.

The error quantity $\epsilon'$ is provided to an error evaluator 135 which functions to determine the minimum error quantity, $\epsilon'_{min}$, from among all values of $\epsilon'$ presented to it (there will be a value $\epsilon'$ for each time warp in the TWCB) and store the value of $\tilde{x}(i)$ associated with $\epsilon'_{min}$, namely $\tilde{x}_{min}(i)$.

Once $\tilde{x}_{min}(i)$ is determined, the scale factor $\lambda(i)$ is determined by process 136. Process 136 comprises software which implements equation (13).

$$\lambda(i) = \frac{\tilde{x}_{\min}(i)^T H^T H\hat{x}(i-M)}{\hat{x}(i-M)^T H^T H\hat{x}(i-M)}. \tag{13}$$

This scale factor is multiplied by $\hat{x}(i-M)$ and provided as output.

Referring again to FIG. 3, $\tilde{x}_{min}(i)$ and adaptive codebook estimate $\lambda(i)\hat{x}(i-M)$ are supplied to circuit 160 which subtracts estimate $\lambda(i)\hat{x}(i-M)$ from warped original $\tilde{x}_{min}(i)$. The result is excitation signal r(i) which is supplied to a fixed stochastic codebook search process 170.

Codebook search process 170 operates conventionally to determine which of the fixed stochastic codebook vectors, z(i), scaled by a factor, $\mu(i)$, most closely matches r(i) in a least squares, perceptually weighted sense. The chosen scaled fixed codebook vector, $\mu(i)z_{min}(i)$, is added to the scaled adaptive codebook vector, $\lambda(i)\hat{x}(i-M)$, to yield the best estimate of a current reconstructed speech signal, $\hat{x}(i)$. This best estimate, $\hat{x}(i)$, is stored in the adaptive codebook 150.

As is the case with conventional speech coders, LTP delay and scale factor values, $\lambda$ and M, a FSCB index, and linear prediction coefficients, $a_n$, are supplied to a decoder across a channel for reconstruction by a conventional CELP receiver. However, because of the reduced error (in the coding process) afforded by operation of the illustrative embodiment of the present invention, it is possible to transmit LTP delay information, M, once per frame, rather than once per subframe. Subframe values for M may be provided at the receiver by interpolating the delay values in a fashion identical to that done by delay estimator 140 of the transmitter.

By transmitting LTP delay information M every frame rather than every subframe, the bandwidth requirements associated with delay may be significantly reduced.

An LTP with a Continuous Delay Contour

For a conventional LTP, delay is constant within each subframe, changing discontinuously at subframe boundaries. This discontinuous behavior is referred to as a stepped delay contour. With stepped delay contours, the discontinuous changes in delay from subframe to subframe correspond to discontinuities in the LTP mapping of past excitation into the present. These discontinuities are modified by interpolation, and they may prevent the construction of a signal with a smoothly evolving pitch-cycle waveform. Because interpolation of delay values is called for in the illustrative embodiments discussed above, it may prove advantageous to provide an LTP with a continuous delay contour more naturally facilitating interpolation. Since this reformulated LTP provides a delay contour with no discontinuities, it is referred to as a continuous delay contour LTP.

The process by which delay values of a continuous delay contour are provided to an adaptive codebook supplants that described above for delay estimator 140. To provide a continuous delay contour for the LTP, the best of a set of possible contours over the current subframe is selected. Each contour starts at the end value of the delay contour of the previous subframe, $d(t_j)$. In the present illustrative embodiment, each of the delay contours of the set are chosen to be linear within a subframe. Thus, for current subframe j of N samples (spaced at the sampling interval T), which ranges over $t_j<t\leqq t_{j+1}$, the instantaneous delay d(t) is of the form:

$$d(t)=d(t_j)+\alpha(t-t_j),\ t_j<t\leqq t_{j+1}, \tag{14}$$

where $\alpha$ is a constant. For a given d(t), the mapping of a past speech signal (unscaled by an LTP gain) into the present by an LTP is:

$$u(t)=\hat{x}(t-d(t)),\ t_j<t\leqq t_{j+1}. \tag{15}$$

Equation (15) is evaluated for the samples $t_j$, $t_j$+T, . . . , $t_j$'(N−1)T. For non-integer delay values, the signal value $\hat{x}(t-d(t))$ must be obtained with interpolation. For the determination of the optimal piecewise-linear delay contour, we have a set of Q trial slopes $\alpha_1, \alpha_2, \ldots, \alpha_Q$, for each of which the sequence $u(t_j)$, $u(t_j+T)$, . . . , $u(t_j+(N-1)T)$ is evaluated. The best quantized value of $d(t_j)$ can then be found using equation (8). That is, equation (8) may be used to provide a perceptually weighted, least squares error estimate between $\hat{x}(t)$ and $\hat{x}(t-d(t))$. Referring to FIG. 3 as it might be adapted for the present embodiment, the value of $d(t_j)$ is passed from delay estimator 140 to adaptive codebook 150 in lieu of M.

When using an LTP with a continuous delay contour to obtain a time-scaled version of the past signal, it is preferred that the slope of the delay contour be less than unit: d(t)<1. If this proposition is violated, local time-reversal of the mapped waveform may occur. Also, a continuous delay contour cannot accurately describe pitch doubling. To model pitch doubling, the delay contour must be discontinuous. Consider again the delay contour of equation (14). Because each pitch period is usually dominated by one major center of energy (the pitch pulse), it is preferred the delay contour be provided with one degree of freedom per pitch cycle. Thus, the illustrative continuous delay-contour LTP provides subframes with an adaptive length of approximately one pitch cycle. This adaptive length is used to provide for subframe boundaries being placed just past the pitch pulses. By so doing, an oscillatory delay contour can be avoided. Since the LTP parameters are transmitted at fixed time intervals, the subframe size does not affect the bit rate. In this illustrative embodiment, known methods for locating the pitch pulses, and thus delay frame boundaries, are applicable. These methods may be applied as part of the adaptive codebook process 150.

An Illustrative Embodiment for CELP Coding Involving Time-Shifting

Figure 5:
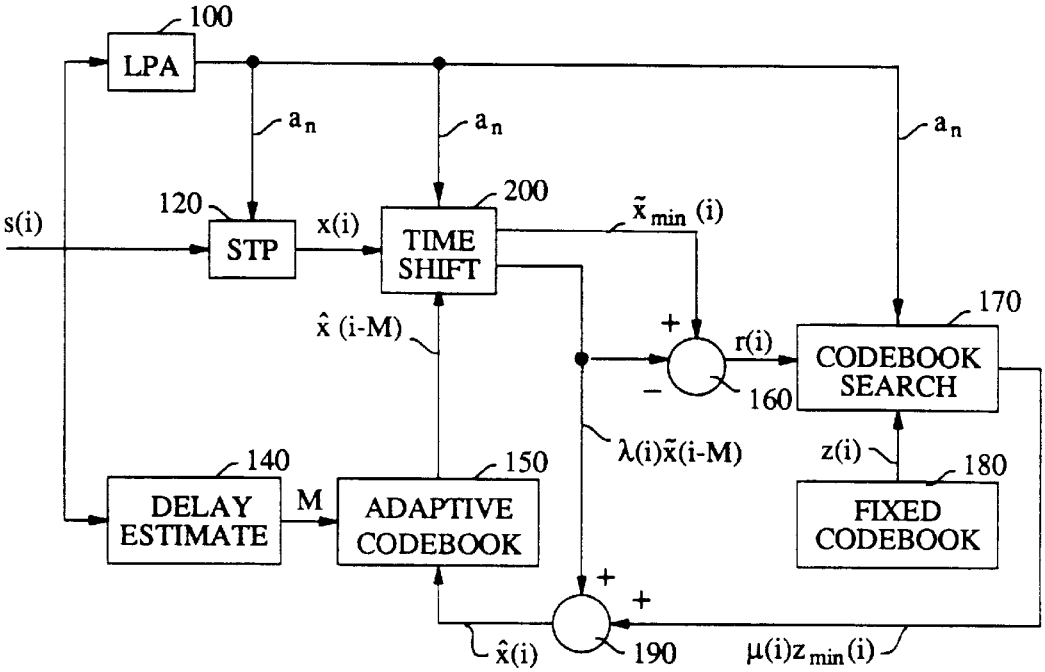
FIG. 5 presents an illustrative embodiment of the present invention concerning time-shifting.

In addition to the time-warping embodiments discussed above, a time-shifting embodiment of the present invention may be employed. Illustratively, a time-shifting embodiment may take the form of that presented in FIG. 5, which is similar to that of FIG. 3 with the time-warp function 130 replaced with a time-shift function 200.

Like the time-warp function 130, the time-shift function 200 provides multiple trial original signals which are constrained to be audibly similar to the original signal to be coded. Like the time-warp function 130, the time-shift function 200 seeks to determine which of the trial original signals generated is closest in form to an identified past speech signal. However, unlike the time-warp function 130, the time-shift function 200 operates by sliding a subframe of the original speech signal, preferably the excitation signal x(i), in time by an amount $\theta, \theta_{min}\leqq\theta\leqq\theta_{max}$, to determine a position of the original signal which yields minimum error when compared with a past speech signal (typically, $|\theta_{min}|=|\theta_{max}|=2.5$ samples, achieved with up-sampling). The shifting of the original speech signal by an amount $\theta$ to the right (i.e., later in time) is accomplished by repeating the last section of length $\theta$ of the previous subframe thereby padding the left edge of the original speech subframe. The shifting of the original speech signal by an amount $\theta$ to the left is accomplished by simply removing (i.e., omitting) a length of the original signal equal to $\theta$ from the left edge of the subframe. As with time-warping, minimum error is generally associated with time-matching the major pitch pulses in a subframe as between two signals. The operations of padding and omitting samples of the original signal are performed by pad/omit process 232.

Note that the subframe size need not be a function of the pitch-period. It is preferred, however, that the subframe size be always less than a pitch period. Then the location of each pitch pulse can be determined independently. A subframe size of 2.5 ms can be used. Since the LTP parameters are transmitted at fixed time intervals, the subframe size does not affect the bit rate. To prevent subframes from falling between pitch pulses, the change in shift must be properly restricted (of the order of 0.25 ms for a 2.5 ms subframe). Alternatively, the delay can be kept constant for subframes where the energy is much lower than that of surrounding subframes.

Figure 6:
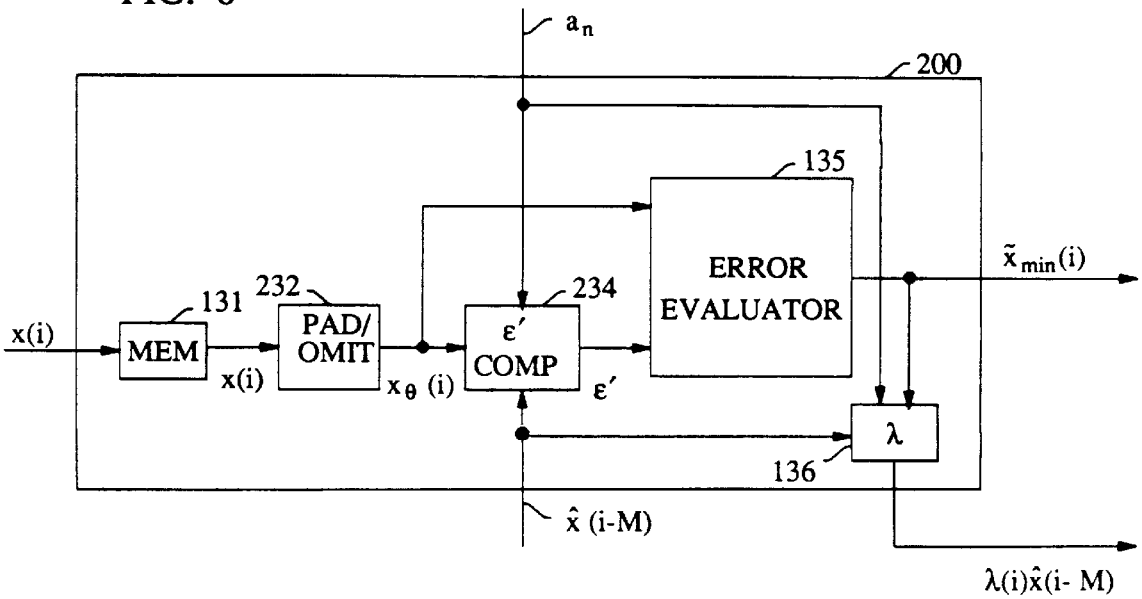
FIG. 6 presents an illustrative time-shifting function for the embodiment presented in FIG. 5.

An illustrative time-shift function 200 is presented in FIG. 6. The function 200 is similar to the time-warp function 130 discussed above with a pad/omit process 232 in place of warping process 132 and associated codebook 133. The shifting procedure performed by function 200 is:

$$x_\theta(\tau)=x(t_j-\theta),\ \tau_j<\tau\leqq\tau_{j+1}, \tag{16}$$

where $t_j$ denotes the start of current frame j in the original signal. A closed-loop fitting procedure searches for the value of $\theta_{min}\leqq\theta\leqq\theta_{max}$, which minimizes an error criterion similar to equation (12):

$$\varepsilon' = \frac{[(x_\theta(i)+q(i))^T H^T Hx(i-M)]^2}{(x_\theta(i)+q(i))^T H^T H(x_\theta(i)+q(i))x(i-M)^T H^T Hx(i-M)}. \tag{17}$$

This procedure is carried out by process 234 (which determines $\epsilon'$ according to equation (17)) and error evaluator 135 (which determines $\epsilon'_{min}$).

The optimal value of $\theta$ for the subframe j is that $\theta$ associated with $\epsilon'_{min}$ and is denotes as $\theta_j$. For a subframe length $L_{subframe}$, the start of subframe j+1 in the original speech is now determined by:

$$t_{j+1}=t_j+L_{subframe}+\theta_j, \tag{18}$$

while for the reconstructed signal the time $\tau_{j+1}$ simply is:

$$\tau_{j+1}=\tau_j+L_{subframe}. \tag{19}$$

As is the case with the illustrative embodiments discussed above, this embodiment of the present invention provides scaling and delay information, linear prediction coefficients, and fixed stochastic codebook indices to a conventional CELP receiver. Again, because of reduced coding error provided by the present invention, delay information may be transmitted every frame, rather than every subframe. The receiver may interpolate delay information to determine delay values for individual subframes as done by delay estimator 140 of the transmitter.

Interpolation with a stepped-delay contour may proceed as follows. Let $t_A$ and $t_B$ denote the beginning and end of the present interpolation interval, for the original signal. Further, we denote with the index $j_A$ the first LTP subframe of the present interpolation interval, and $j_B$ the first LTP subframe of the next interpolation interval. First, an open-loop estimate of the delay at the end of the present interpolation interval, $d_B$, is obtained by, for example, a cross-correlation process between past and present speech signals. (In fact the value used for $t_B$ for this purpose must be an estimate, since the final value results after conclusion of the interpolation.) Let the delay at the end of the previous interpolation interval be denoted as $d_A$. Then the delay of subframe j can simply be set to be:

$$d_j = \frac{j_B - j}{j_B - j_A} d_A + \frac{j - j_A}{j_B - j_A} d_B,\ j_A \le j < j_B. \tag{20}$$

The unscaled contribution of the LTP to the excitation is then given by:

$$u(\tau)=\hat{x}(\tau-d_j),\ \tau_j<\tau\leqq\tau_{j+1}, \tag{21}$$

where $\tau_j$ is the beginning of the subframe j, for the reconstructed signal.

Delay Pitch Doubling and Halving

Analysis-by-synthesis coders often suffer from delay doubling or halving due to the similarity of successive pitch-cycles. Such doubling or halving of delay is difficult to prevent in many practical applications. However, regarding the present invention, delay doubling or halving can be accommodated as follows. As a first step, the open-loop delay estimate for the endpoint in the present interpolation interval is compared with the last delay in the previous interpolation interval. When ever it is close to a multiple or submultiple of the previous interpolation interval endpoint, then delay multiplication or division is considered to have occurred. What follows is a discussion of how to address delay doubling and delay having; other multiples may be addressed similarly.

Regarding delay doubling, let an open-loop estimate of the end value delay be denoted as $d_2(\tau_B)$, where the subscript $_2$ indicates that the delay corresponds to two pitch cycles. Let $d_1(\tau_A)$ represent a delay corresponding to one pitch cycle. In general, the doubled delay and the standard delay are related by:

$$d_2(\tau)=d_1(\tau)+d_1(\tau-d_1(\tau)). \tag{22}$$

Equation (22) describes two sequential mappings by an LTP. A simple multiplication of the delay by two does not result in a correct mapping when the pitch period is not constant.

Now consider the case where $d_1(\tau)$ is linear within the present interpolation interval:

$$d_1(\tau)=d_1(\tau_A)+\beta(\tau-\tau_A). \tag{23}$$

Then combination of equations (22) and (23) gives:

$$d_2(\tau)=(2-\beta)\ d_1(\tau_A)+(2-\beta)\beta\ (\tau-\tau_A),\ \tau-d_1(\tau)>\tau_A. \tag{24}$$

Equation (24) shows that, within a restricted range, $d_2(\tau)$ is linear. However, in general, $d_2(\tau)$ is not linear in the range where $\tau_A<\tau<\tau_A+d_1(\tau)$. The following procedure can be used for delay doubling. At the outset $d_1(\tau_A)$ and $d_2(\tau_B)$ are known. By using $\tau=\tau_B$ in equation (24), $\beta$ can be obtained:

$$\beta = \frac{2(\tau_B - \tau_A) - d_1(\tau_A) - ((2(\tau_B - \tau_A) - d_1(\tau_A))^2 + 4(\tau_B - \tau_A)(2d_1(\tau_A) - d_2(\tau_B)))^{1/2}}{2(\tau_B - \tau_A)} \tag{25}$$

Then both $d_1(\tau)$ and $d_2(\tau)$ are known within the interpolation interval. The standard delay, $d_1(\tau)$ satisfies equation (23) within the entire interpolation interval. For $d_2(\tau)$, note that equation (22) is valid over the entire interpolation interval, while equation (24) is valid over only a restricted part.

The actual LTP excitation contribution for the interpolation interval is now obtained by a smooth transition from the standard to the double delay:

$$u(\tau)=\psi(\tau)\ \hat{x}(\tau-d_2(\tau))+(1-\psi(\tau))\ \hat{x}(\tau-d_1(\tau)),\ \tau_A<\tau\leqq\tau_B \tag{26}$$

where $\psi(\tau)$ is a smooth function increasing from 0 to 1 over the indicated interpolation interval, which delineates the present interpolation interval. This procedure assumes that the interpolation interval is sufficiently larger than the double delay.

For delay halving, the same procedure is used in the opposite direction. Assume the boundary conditions $d_2(\tau_A)$ and $d_1(\tau_B)$. To be able to use equation (22) for $\tau_A<\tau\leqq\tau_B$, $d_1(\tau_A)$ must be defined in the range $\tau_A-d_1(\tau_A)<\tau\leqq\tau_A$. A proper definition will maintain good speech quality. Since the double delay will be linear in the previous interpolation interval, we can use equation (24) to obtain a reasonable definition of $d_1(\tau)$ in this range. For a linear delay contour, $d_2(\tau)$ satisfies:

$$d_2(\tau)=d_2(\tau'_A)+\eta'(\tau-\tau'_A),\ \tau_A-d_1(\tau_A)<\tau\leqq\tau_A, \tag{27}$$

where the ' indicates that the values refer to the previous interpolation interval (note that $\tau'_B=\tau_A$), and where $\eta'$ is a constant. Comparing this with equation (24), $d_1(\tau)$ in the last part of the previous interpolation interval is:

$$d_1(\tau) = \frac{d_2(\tau'_A)}{1+\sqrt{1-\eta'}} + \left(1-\sqrt{1-\eta'}\right)(\tau-\tau'_A),\ \tau_A - d_1(\tau_A) < \tau \le \tau_A. \tag{28}$$

Equation (28) provides also a boundary value for the present interpolation interval, $d_1(\tau_A)$. From this value and $d_1(\tau_B)$, the value of $\beta$ for equation (23) can be computed. Again, equation (22) can be used to compute $d_2(\tau)$ in the present interpolation interval. The transition from $d_2(\tau)$ to $d_1(\tau)$ is again performed by using equation 22, but now $\psi(\tau)$ decreases from 1 to 0 in the interpolation interval.

What is claimed is:

1. A method for coding an original signal representative of speech, the method comprising the steps of:

a. generating a plurality of distinct trial original signals by varying the original signal a corresponding plurality of times, each of said distinct trial original signals corresponding to and being a different variation of the original signal;

b. for each of the plurality of distinct trial original signals, performing an encoding of said trial original signal to generate a corresponding encoded trial original signal, performing a decoding of said corresponding encoded trial original signal to generate a corresponding synthesized trial original signal, and comparing said trial original signal to said corresponding synthesized trial original signal to determine a corresponding measure of similarity therebetween;

c. selecting one of said trial original signals for use in coding the original signal based on an evaluation of one or more of said measures of similarity; and d. coding the original signal based on the encoded trial original signal corresponding to the selected trial original signal.

2. The method of claim 1 wherein the step of generating a plurality of distinct trial original signals comprises the step of varying the time scale of the original signal according to a plurality of time warp functions.

3. The method of claim 1 wherein the step of generating a plurality of distinct trial original signals comprises the step of performing time shifts of the original signal.

4. The method of claim 1 wherein the evaluation of said measures of similarity comprises determining a sum of squares of differences of samples of the trial original signal and of said corresponding synthesized trial original signal.

5. The method of claim 1 wherein the step of selecting comprises selecting a trial original signal having a similarity measure which satisfies a similarity criterion.

6. The method of claim 1 wherein the evaluation of said measures of similarity comprises determining a sum of squares of differences of samples of a perceptually weighted trial original signal and of a perceptually weighted synthesized trial original signal corresponding thereto.

7. The method of claim 1 wherein the step of determining comprises selecting a trial original signal having a similarity measure which satisfies a similarity criterion.

8. The method of claim 1 wherein the encoding of said trail original signal comprises the step of producing one or more parameters representative thereof, and wherein the decoding of said encoded trial original signal comprises the step of generating said corresponding synthesized trial original signal based on one or more of said parameters.

9. The method of claim 1 wherein each of the synthesized trial original signals is of a duration equal to a subframe.

10. The method of claim 1 wherein each trial original signal is of a duration equal to a subframe.

11. An apparatus for coding an original signal representative of speech, the apparatus comprising:

a. means for generating a plurality of distinct trial original signals by varying the original signal a corresponding plurality of times, each of said distinct trial original signals corresponding to and being a different variation of the original signal;

b. means, applied to each of the plurality of distinct trial original signals, for performing an encoding of said trial original signal to generate a corresponding encoded trial original signal, for performing a decoding of said corresponding encoded trial original signal to generate a corresponding synthesized trial original signal, and for comparing said trial original signal to said corresponding synthesized trial original signal to determine a corresponding measure of similarity therebetween;

c. means for selecting one of said trial original signals for use in coding the original signal based on an evaluation of one or more of said measures of similarity; and d. means for coding the original signal based on the encoded trial original signal corresponding to the selected trial original signal.

12. The apparatus of claim 11 wherein the means for generating a plurality of distinct trial original signals comprises means for applying a time-warp function to the original signal.

13. The apparatus of claim 12 wherein the means for applying a time warp function comprises a codebook of signals representing time warps.

14. The apparatus of claim 11 wherein the means for generating a plurality of distinct trial original signals comprises means for performing a time-shift of the original signal.

15. The apparatus of claim 11 wherein the evaluation of said measures of similarity is performed by means for determining a sum of squares of differences of samples of the trial original signal and of said corresponding synthesized trial original signal.

16. The apparatus of claim 15 wherein the difference between the trial original signal and the corresponding synthesized trial original signal is perceptually weighted.

17. The apparatus of claim 11 wherein the means for selecting the trial original signal for use in coding comprises means for determining a trial original signal having a similarity measure which satisfies a similarity criterion.

18. The apparatus of claim 11 wherein said means for performing an encoding of said trial original signals comprises means for producing one or more parameters representative thereof, and wherein said means for performing a decoding of said encoded trial original signals comprises means for generating said corresponding synthesized trial original signal based on one or more of said parameters.

19. The apparatus of claim 11 wherein each of the synthesized trial original signals is of a duration equal to a subframe.

20. The apparatus of claim 11 wherein each trial original signal is of a duration equal to a subframe.

* * * * *